US010456322B2

(12) United States Patent
Yang

(10) Patent No.: US 10,456,322 B2
(45) Date of Patent: Oct. 29, 2019

(54) MASSAGE SHOWER HEAD

(71) Applicant: Purity (Xiamen) Sanitary Ware Co., Ltd., Xiamen, Fujian (CN)

(72) Inventor: Xiwen Yang, Xiamen (CN)

(73) Assignee: PURITY (XIAMEN) SANITARY WARE CO., LTD., Xiamen, Fujian (CN)

( * ) Notice: Subject to any disclaimer, the term of this patent is extended or adjusted under 35 U.S.C. 154(b) by 24 days.

(21) Appl. No.: 15/871,091

(22) Filed: Jan. 15, 2018

(65) Prior Publication Data

US 2019/0216678 A1 Jul. 18, 2019

(51) Int. Cl.

*A61H 15/00* (2006.01)
*B05B 1/18* (2006.01)
*E03C 1/04* (2006.01)

(52) U.S. Cl.

CPC ..... *A61H 15/0092* (2013.01); *B05B 1/185* (2013.01); *E03C 1/0409* (2013.01); *A61H 2015/0064* (2013.01); *A61H 2201/0115* (2013.01); *A61H 2201/0153* (2013.01); *A61H 2201/1253* (2013.01); *A61H 2201/1673* (2013.01)

(58) Field of Classification Search

CPC ..... B05B 1/18; B05B 1/185; E03C 1/0409; A61H 15/0092; A61H 2015/0064; A61H 2201/0115; A61H 2201/0153; A61H 2201/1253; A61H 2201/1673

See application file for complete search history.

(56) References Cited

U.S. PATENT DOCUMENTS 5,385,532 A * 1/1995 Shyu ..... A46B 13/06 15/29
6,338,170 B1 * 1/2002 De Simone ..... A46B 13/06 4/606
6,981,953 B1 * 1/2006 Ko ..... A61H 7/003 601/138
8,652,078 B2 * 2/2014 Lee ..... B05B 1/083 239/102.1
2017/0239671 A1 * 8/2017 Mirkov ..... B05B 15/50

FOREIGN PATENT DOCUMENTS

DE 29509823 U1 * 8/1995 ..... A61H 15/0092
GB 196951 A * 4/1923 ..... A61H 7/003
WO WO-2013156921 A1 * 10/2013 ..... B05B 1/18
WO WO-2016008434 A1 * 1/2016 ..... A47K 3/28

* cited by examiner

*Primary Examiner* — Darren W Gorman
(74) *Attorney, Agent, or Firm* — Leong C. Lei

(57) ABSTRACT

A massage shower head includes a main body, a water outlet cover, and a plurality of massage balls. The main body is provided with a water inlet. A front of the main body is defined as a water outlet side. The water outlet cover covers the water outlet side of the main body. The massage balls are movably disposed between the main body and the water outlet cover. The water outlet cover has a plurality of openings. The massage balls partially extend out from the openings, respectively. The massage balls are arranged on the water outlet side of the shower head to realize the massage function while taking a shower and achieve the effect of scrubbing the user's skin.

9 Claims, 6 Drawing Sheets

MASSAGE SHOWER HEAD

BACKGROUND OF THE INVENTION

1. Field of the Invention

The present invention relates to a bathroom accessory, and more particularly to a massage shower head.

2. Description of the Prior Art

A conventional massage shower head provides a massage effect through regular vibrating water outflow. There are some shower heads with a massage structure developed on the market. As shown in FIG. 1, Chinese Patent Application No. 201220139455.8 discloses a shower head having a massage function, which comprises a handle 10 and a spray head 20 provided at the front end of the handle 10. The front of the spray head 20 is a water outlet panel. The rear of the spray head 20 is provided with massage balls 30. Specifically, the rear of the spray head 20 is formed with a plurality of bosses 220 each having a top opening. The central portion of each boss 220 is formed with an accommodation chamber 230 corresponding to the top opening. The side wall of each boss 220 is formed with grooves 240. The inner side of the top opening of each boss 220 is provided with a flange 250. The massage ball 30 is mounted in the accommodation chamber 230. The diameter of the massage ball 30 is slightly less than the accommodation chamber 230 and slightly greater than the diameter of the flange 250. A part of the massage ball 30 extends out of the accommodation chamber 230 to form a massage head. The water outlet panel on the front of the shower head realizes a traditional shower function, and the massage balls on the rear of the shower head realize a massage function. The disadvantage is that the shower function and the massage function cannot be implemented at the same time. The water outlet of the shower head must be closed when the shower head is used for massage. As a result, the shower head cannot be used to take a shower while it is used for massage. The dirt generated by scrubbing cannot be removed in time. The massage ball 30 is pressed into the accommodation chamber 230. It is difficult to prevent the massage ball 30 from falling out by using the flange 250 only. For massage, when the shower head is moved transversely, the massage ball 30 may fall out easily.

Accordingly, the inventor of the present invention has devoted himself based on his many years of practical experiences to solve these problems and develop a massage shower head that is stable in structure and capable of both massage and shower functions.

SUMMARY OF THE INVENTION

The primary object of the present invention is to provide a massage shower head, which can simultaneously realize a massage function at the time of taking a shower and remove the dirt generated by scrubbing the skin of the user.

In order to achieve the aforesaid object, the massage shower head of the present invention comprises a main body, a water outlet cover, and a plurality of massage balls. The main body is provided with a water inlet. A front of the main body is defined as a water outlet side. The water outlet cover covers the water outlet side of the main body. The massage balls are movably disposed between the main body and the water outlet cover. The water outlet cover has a plurality of openings. The massage balls partially extend out from the openings, respectively.

Preferably, the massage shower head further comprises a multifunctional sealing seat and a water outlet sleeve. The multifunctional sealing seat is mounted on the front of the main body. The multifunctional sealing seat is provided with a plurality of water drain holes communicated with the water inlet. The water outlet cover covers the multifunctional sealing seat. An inner side of the water outlet cover is formed with a plurality of partitions. The partitions divide the inner side of the water outlet cover into a plurality of independent water chambers and accommodation chambers. The water chambers are in communication with the plurality of water drain holes, respectively. The water outlet cover is formed with a plurality of insertion holes corresponding in position to the water chambers. The water outlet sleeve is disposed between the water outlet cover and the multifunctional sealing seat and attached to the inner side of the water outlet cover. The water outlet sleeve is formed with a plurality of guide posts with water apertures corresponding to the insertion holes. The guide posts pass through the insertion holes of the water outlet cover, respectively. The massage balls are movably disposed in the accommodation chambers, respectively. The openings correspond in position to the accommodation chambers.

Preferably, the main body is formed with a water passage. The water passage communicates the water inlet with the water drain holes of the multifunctional sealing seat.

Preferably, the water outlet sleeve is formed with notches corresponding in position to the accommodation chambers.

Preferably, a front of the multifunctional sealing seat is formed with a plurality of support bosses corresponding in position to the massage balls in the accommodation chambers for supporting the massage balls. A surface of each of the support bosses is formed with a concave surface to match with a spherical surface of a corresponding one of the massage balls. The support bosses are formed with water holes for communicating the accommodation chambers with the water inlet of the main body.

Preferably, the multifunctional sealing seat is insertedly mounted on the front of the main body. The water outlet cover is insertedly mounted on the multifunctional sealing seat.

Preferably, a periphery of the opening of each accommodation chamber is formed with a stop ring which is gradually reduced toward its center. The inner side of the water outlet cover is divided into five accommodation chambers through the partitions. One of the accommodation chambers is located at a center of the water outlet cover. The other four accommodation chambers are equally spaced around the central accommodation chamber.

Preferably, the stop ring formed on the periphery of the opening of each accommodation chamber is inclined from an outer side to the center of the water outlet cover.

Preferably, the massage shower head further comprises a handle connected to the main body, a water inlet tube disposed in the handle, and a push-button water valve disposed on the water inlet tube. One end of the water inlet tube is inserted in the water inlet.

Preferably, the massage balls are steel balls.

When the massage shower head of the present invention is used, the water flows into the main body and flows out from the water outlet cover. The water outlet cover of the shower head is attached to the human body and moved back and forth on the skin of the human body. The massage balls extending out of the openings of the water outlet cover are used to scrub the user's skin and achieve the effect of "scrubbing the skin".

The beneficial effects of the present invention are as follows: the massage balls are installed on the water outlet side of the shower head, which can massage the body while taking a shower, and the dirt generated by scrubbing can be removed in time. The present invention has the advantages of stable structure, convenient use and simple operation.

DETAILED DESCRIPTION OF THE PREFERRED EMBODIMENTS

Figure 1:
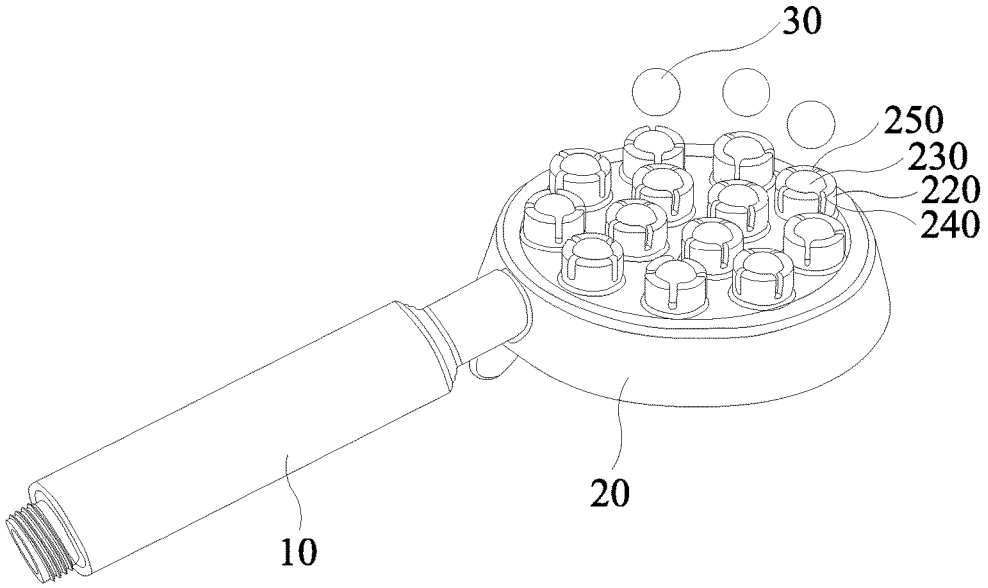
Prior art F I G. 1
FIG. 1 is a schematic view of a conventional shower head having a massage function.
Figure 2:
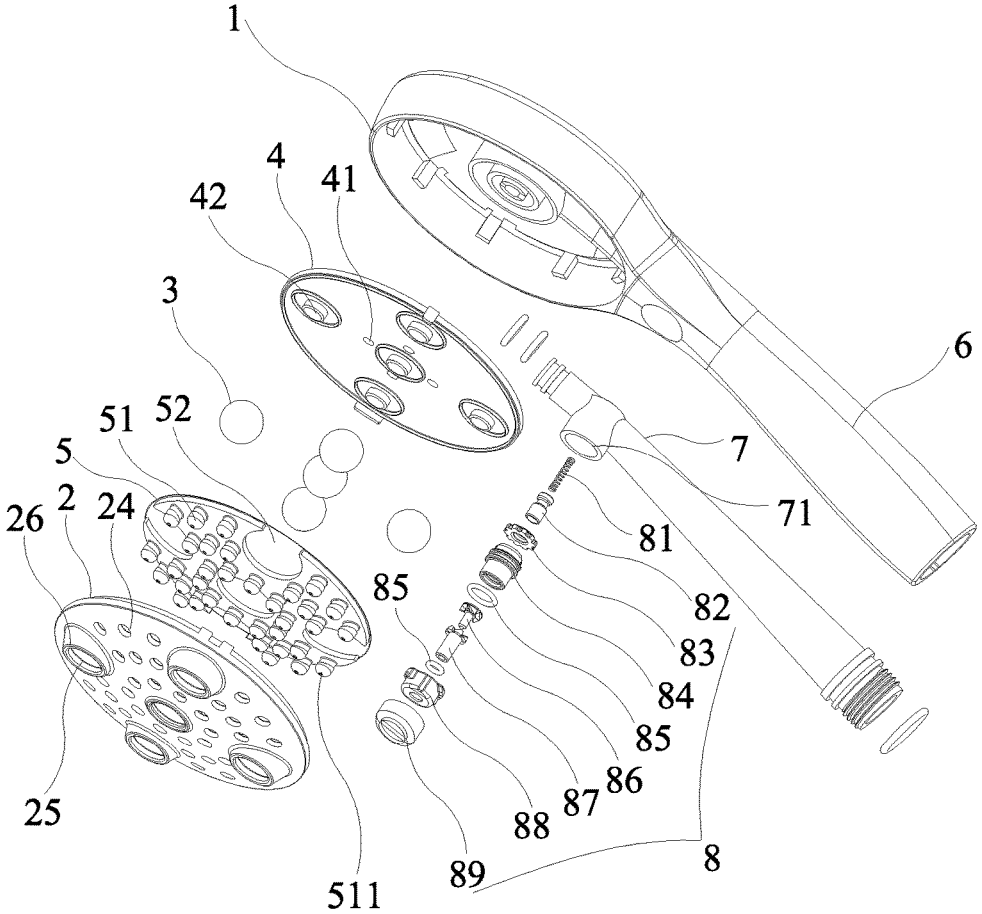
FIG. 2 is an exploded view of the present invention.
Figure 3:
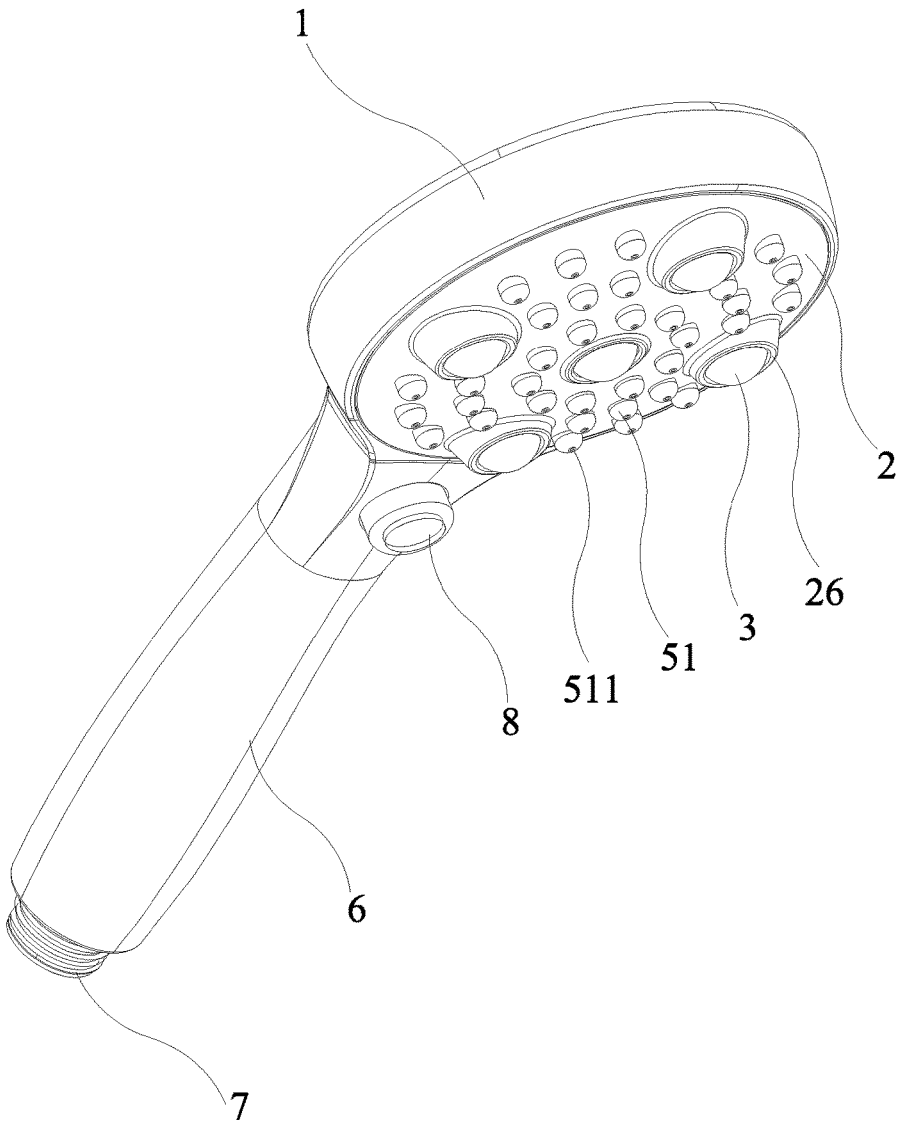
FIG. 3 is a perspective view of the present invention.
Figure 4:
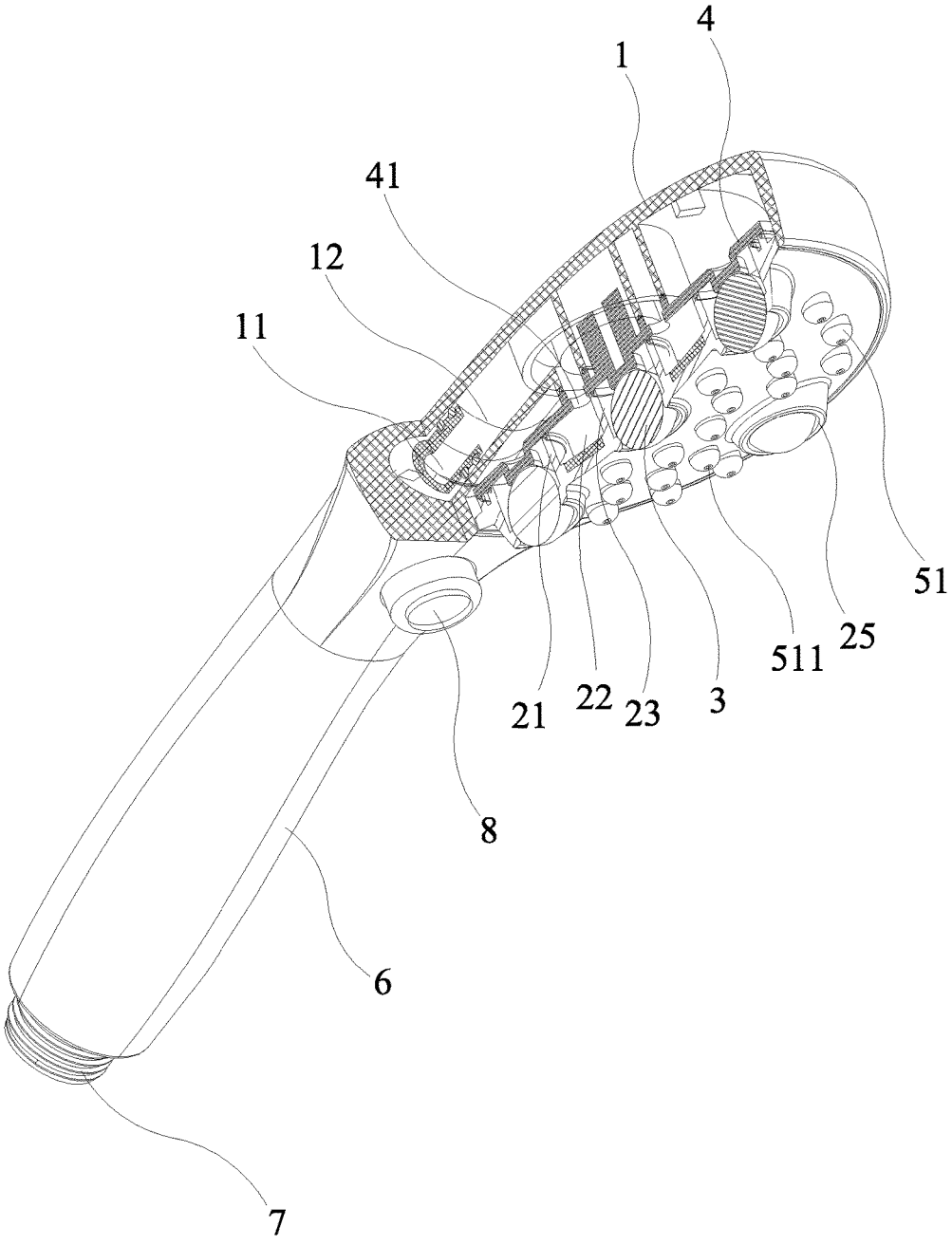
FIG. 4 is a partial sectional view of the present invention.
Figure 5:
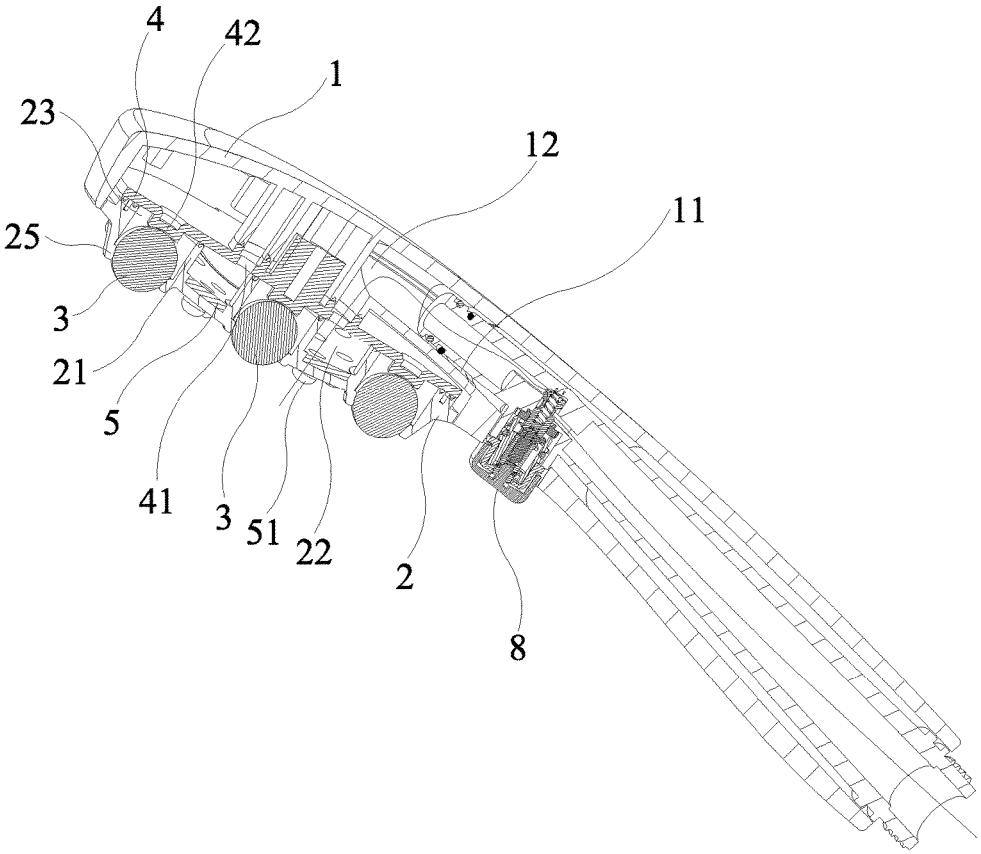
FIG. 5 is a cross-sectional view of the present invention, not in a discharge state.

Embodiments of the present invention will now be described, by way of example only, with reference to the accompanying drawings.

As shown in FIG. 2 to FIG. 6, the present invention discloses a massage shower head. The massage shower head comprises a main body 1, a water outlet cover 2, and a plurality of massage balls 3. The massage balls 3 are preferably steel balls or balls of other materials. The main body 1 is provided with a water inlet 11. The front of the main body 1 is defined as a water outlet side. The water outlet cover 2 covers the water outlet side of the main body 1. The massage balls 3 are movably disposed between the main body 1 and the water outlet cover 2. The water outlet cover 2 has a plurality of openings 25. The massage balls 3 partially extend out from the openings 25, respectively.

In order to improve the stability of the shower head structure, the massage shower head of this embodiment further includes a multifunctional sealing seat 4 and a water outlet sleeve 5 on the basis of the water outlet cover 2. The multifunctional sealing seat 4 is mounted on the front of the main body 1. The multifunctional sealing seat 4 is provided with a plurality of water drain holes 41 communicated with the water inlet 11. The water outlet cover 2 covers the multifunctional sealing seat 4. An inner side of the water outlet cover 2 is formed with a plurality of partitions 21. The partitions 21 divide the inner side of the water outlet cover 2 into a plurality of independent water chambers 22 and accommodation chambers 23. Wherein, the water chambers 22 are in communication with the plurality of water drain holes 41, respectively. The water outlet cover 2 is formed with a plurality of insertion holes 24 corresponding in position to the water chambers 22. The water outlet sleeve 5 is disposed between the water outlet cover 2 and the multifunctional sealing seat 4 and attached to the inner side of the water outlet cover 2. The water outlet sleeve 5 is formed with a plurality of guide posts 51 with water apertures 511 corresponding to the insertion holes 24. The guide posts 51 passes through the insertion holes 24 of the water outlet cover 2, respectively. The massage balls 3 are movably disposed in the accommodation chambers 23, respectively. The openings 25 correspond in position to the accommodation chambers 23.

Preferably, the main body 1 is formed with a water passage 12 for the water inlet 11 to communicate with the water drain holes 41 of the multifunctional sealing seat 4. The water passage 12 guides the water entering the main body 1 to the water drain holes 41. The water flows from the water drain holes 41 to the water chambers 22 between the multifunctional sealing seat 4 and the water outlet cover 2. The multifunctional sealing seat 4 not only seals the non-drain portion of the main body 1 but also guides the water.

Preferably, in order to facilitate installation, the water outlet sleeve 5 is formed with notches 52 corresponding in position to the accommodation chambers 23.

Preferably, the front of the multifunctional sealing seat 4 is formed with a plurality of support bosses 42 corresponding in position to the massage balls 3 in the accommodation chambers 23 for supporting the massage balls 3. The surface of each support boss 42 is formed with a concave surface to match with the spherical surface of each massage ball 3. The bottom of the massage ball 3 in the accommodation chamber 23 is arranged on the concave surface of the support boss 42 so as to limit the position deviation of the massage ball 3 and ensure the stability of the rolling of the massage ball 3.

Preferably, the multifunctional sealing seat 4 is insertedly mounted on the front of the main body 1. The water outlet cover 2 is insertedly mounted on the multifunctional sealing seat 4. This inserted connection is an easy-to-implement assembly method, so that the shower head can be assembled quickly. The massage balls 3 disposed between the main body 1 and the water outlet cover 2 can be disassembled conveniently.

Preferably, the periphery of the opening 25 of each accommodation chamber 23 is formed with a stop ring 26 which is gradually reduced toward its center. The inner side of the water outlet cover 2 is divided into five accommodation chambers 23 through the partitions 21. One of the accommodation chambers 23 is located at the center of the water outlet cover 2, and the other four accommodation chambers 23 are equally spaced around the central accommodation chamber 23.

Further, the stop ring 26 formed on the periphery of the opening 25 of each accommodation chamber 23 is inclined from the outer side to the center of the water outlet cover 2.

Preferably, the massage shower head further includes a handle 6 connected to the main body 1, a water inlet tube 7 disposed in the handle 6, and a push-button water valve 8 disposed on a valve seat 71 of the water inlet tube 7. One end of the water inlet tube 7 is inserted in the water inlet 11. The push-button water valve 8 is composed of a spring 81, a valve core 82, a gasket 83, a fixing seat 84, an O-shaped sealing ring 85, a connecting shaft 86, a connecting shaft sleeve 87, a fixing tray 88, and a button 89. The valve core 82 can be pushed to move axially by pressing the button 89, thereby closing the waterway of the water inlet tube 7. When the button 89 is released, the waterway is opened.

When the present invention is installed, the multifunctional sealing seat 4 is first installed on the main body 1. The water outlet sleeve 5 is arranged at the inner side of the water outlet cover 2. The guide posts 51 of the water outlet sleeve 5 are inserted into the insertion holes 24, respectively. The massage balls 3 are placed in the accommodation chambers 23. Finally, the water outlet cover 2 covers the main body 1. The front of the main body 1 provides a support for the massage balls 3. The massage balls 3 partially extend out from the openings 25 of the water outlet cover 2, respectively. The massage balls 3 are freely rotatable in the accommodation chambers 23 without falling out.

When the massage shower head of the present invention is used, the water flows into the main body 1 through the water inlet 11, and then enters the water chambers 22 through the water drain holes 41, and finally flows out from the water apertures 511 of the guide posts 51 of the water outlet sleeve 5, meanwhile, the water outlet cover 2 is attached to the human body and moved back and forth on the skin of the human body. The massage balls 3 are used to scrub the user's skin and achieve the effect of "scrubbing the skin".

Figure 6:
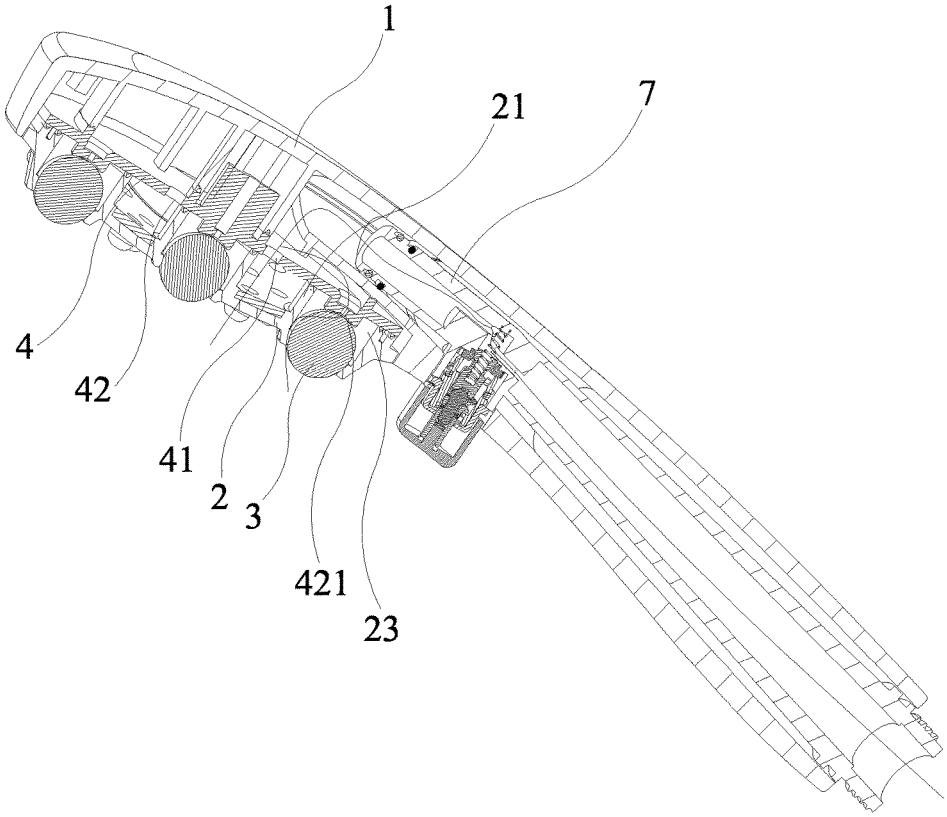
FIG. 6 is a cross-sectional view of the present invention, in a discharge state.

FIG. 6 illustrates another embodiment of the present invention. The support bosses 42 each may be formed with a water hole 421 for communicating the accommodation chambers 23 with the water inlet 11 of the main body 1, so that the water can flow out from the openings 25 along the massage balls 3. When the massage balls 3 are used to massage the user's skin, the water flows out form the surfaces of the massage balls 3 to remove dirt.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A massage shower head, comprising a main body, a water outlet cover and a plurality of massage balls; the main body being provided with a water inlet, a front of the main body being defined as a water outlet side, the water outlet cover covering the water outlet side of the main body, the massage balls being movably disposed between the main body and the water outlet cover, the water outlet cover having a plurality of openings, the massage balls partially extending out from the openings respectively, and further comprising a multifunctional sealing seat and a water outlet sleeve; the multifunctional sealing seat being mounted on the front of the main body, the multifunctional sealing seat being provided with a plurality of water drain holes communicated with the water inlet; the water outlet cover covering the multifunctional sealing seat, an inner side of the water outlet cover being formed with a plurality of partitions, the partitions dividing the inner side of the water outlet cover into a plurality of independent water chambers and accommodation chambers, the water chambers being in communication with the plurality of water drain holes respectively, the water outlet cover being formed with a plurality of insertion holes corresponding in position to the water chambers, the water outlet sleeve being disposed between the water outlet cover and the multifunctional sealing seat and attached to the inner side of the water outlet cover, the water outlet sleeve being formed with a plurality of guide posts with water apertures corresponding to the insertion holes, the guide posts passing through the insertion holes of the water outlet cover respectively; the massage balls being movably disposed in the accommodation chambers respectively, the openings corresponding in position to the accommodation chambers.

2. The massage shower head as claimed in claim 1, wherein the main body is formed with a water passage, and the water passage communicates the water inlet with the water drain holes of the multifunctional sealing seat.

3. The massage shower head as claimed in claim 1, wherein the water outlet sleeve is formed with notches corresponding in position to the accommodation chambers.

4. The massage shower head as claimed in claim 1, wherein a front of the multifunctional sealing seat is formed with a plurality of support bosses corresponding in position to the massage balls in the accommodation chambers for supporting the massage balls, a surface of each of the support bosses is formed with a concave surface to match with a spherical surface of a corresponding one of the massage balls, and the support bosses are formed with water holes for communicating the accommodation chambers with the water inlet of the main body.

5. The massage shower head as claimed in claim 1, wherein the multifunctional sealing seat is insertedly mounted on the front of the main body, and the water outlet cover is insertedly mounted on the multifunctional sealing seat.

6. The massage shower head as claimed in claim 1, wherein a periphery of the opening of each accommodation chamber is formed with a stop ring which is gradually reduced toward its center; the inner side of the water outlet cover is divided into five accommodation chambers through the partitions, one of the accommodation chambers is located at a center of the water outlet cover, and the other four accommodation chambers are equally spaced around the central accommodation chamber.

7. The massage shower head as claimed in claim 6, wherein the stop ring formed on the periphery of the opening of each accommodation chamber is inclined from an outer side to the center of the water outlet cover.

8. The massage shower head as claimed in claim 1, further comprising a handle connected to the main body, a water inlet tube disposed in the handle and a push-button water valve disposed on the water inlet tube, one end of the water inlet tube being inserted in the water inlet.

9. The massage shower head as claimed in claim 1, wherein the massage balls are steel balls.

* * * * *